US007355140B1

(12) United States Patent
Afsari

(10) Patent No.: US 7,355,140 B1
(45) Date of Patent: Apr. 8, 2008

(54) METHOD OF AND APPARATUS FOR MULTI-STAGE SORTING OF GLASS CULLETS

(75) Inventor: Farook Afsari, Menlo Park, CA (US)

(73) Assignee: eCullet, Menlo Park, CA (US)

( * ) Notice: Subject to any disclaimer, the term of this patent is extended or adjusted under 35 U.S.C. 154(b) by 149 days.

(21) Appl. No.: 10/637,188

(22) Filed: Aug. 8, 2003

Related U.S. Application Data

(60) Provisional application No. 60/403,297, filed on Aug. 12, 2002.

(51) Int. Cl.
*B07C 5/00* (2006.01)

(52) U.S. Cl. ..... 209/580; 209/588; 209/576; 209/644

(58) Field of Classification Search ..... 209/576, 209/588, 932, 643, 644, 580
See application file for complete search history.

(56) References Cited

U.S. PATENT DOCUMENTS

| | | | | |
|---|---|---|---|---|
| 2,627,975 A | | 2/1953 | Ekstrom et al. | 209/111 |
| 3,351,198 A | | 11/1967 | Wyman et al. | 209/111.6 |
| 3,489,277 A | | 1/1970 | Silverman | 209/74 |
| 3,650,396 A | | 3/1972 | Gillespie et al. | 209/3 |
| 3,802,558 A | | 4/1974 | Rhys | 209/75 |
| 3,897,330 A | | 7/1975 | Rhys | 209/75 |
| 3,980,180 A | | 9/1976 | Jamieson | 209/111.6 |
| 4,076,979 A | | 2/1978 | Walter et al. | 250/226 |
| 4,131,540 A | | 12/1978 | Husome et al. | 209/582 |
| 4,230,558 A | | 10/1980 | Fulwyler | 209/3.1 |
| 4,276,983 A | | 7/1981 | Witmer | 209/587 |
| 4,278,538 A | | 7/1981 | Lawrence et al. | 209/580 |
| 4,352,430 A | | 10/1982 | Maier et al. | 209/577 |
| 4,379,525 A | | 4/1983 | Nowicki et al. | 241/20 |
| 4,583,695 A | * | 4/1986 | Genestie | 241/24.22 |
| 4,584,455 A | | 4/1986 | Tomizawa | 219/121 |
| 4,630,736 A | | 12/1986 | Maughan et al. | 209/587 |

(Continued)

FOREIGN PATENT DOCUMENTS

JP 59-183340 10/1984

OTHER PUBLICATIONS

"*Classical Imaging and Digital Imaging Spectrophotometric Techniques in Cullets (Glass Fragments ) Sorting*" by Giuseppe Bonifazi, University of Rome, Rome, Italy, pp. 264-277.

*Primary Examiner*—Patrick Mackey
*Assistant Examiner*—Mark Hageman
(74) *Attorney, Agent, or Firm*—Haverstock & Owens LLP

(57) ABSTRACT

A method and system for sorting different colored objects, preferably glass cullets, into separate groups of same colored objects comprising a plurality of sorting devices for receiving an input feed of different colored objects and sorting the different colored objects based on their light transmission properties into a plurality of output feeds, wherein at least one output feed in the plurality of output feeds is a subsequent input feed to one or more sorting devices in the plurality. The one or more sorting devices sort the at least one subsequent input feed into a plurality of further sorted output feeds. At least one of the plurality of sorting devices is a final sorting device, wherein the final sorting device sorts one or more subsequent input feeds into a plurality of final output feeds. The output feeds preferably contain objects of a desired color, undesired objects and flint objects.

73 Claims, 5 Drawing Sheets

U.S. PATENT DOCUMENTS 4,657,144 A 4/1987 Martin et al. ..... 209/546
4,699,273 A 10/1987 Suggi-Liverani et al. ... 209/580
4,699,510 A 10/1987 Alguard ..... 356/73
4,765,489 A 8/1988 Satake ..... 209/557
4,863,041 A 9/1989 Bailey ..... 209/580
4,915,825 A 4/1990 Christie et al. ..... 209/166
4,919,534 A 4/1990 Reed ..... 356/73
4,951,825 A * 8/1990 Hawkins et al. ..... 209/558
4,976,356 A 12/1990 Mizuno et al. ..... 209/539
5,021,645 A 6/1991 Satula et al. ..... 250/223
5,085,325 A 2/1992 Jones et al. ..... 209/580
5,143,308 A 9/1992 Hally et al. ..... 241/76
5,148,923 A 9/1992 Fraenkel et al. ..... 209/539
5,148,993 A 9/1992 Kashiwagi ..... 241/24
5,150,307 A 9/1992 McCourt et al. ..... 364/478
5,156,278 A 10/1992 Aaron et al. ..... 209/556
5,215,772 A 6/1993 Roth ..... 426/231
5,314,071 A * 5/1994 Christian et al. ..... 209/4
5,314,072 A * 5/1994 Frankel et al. ..... 209/44.1
5,315,384 A 5/1994 Heffington et al. ..... 348/93
5,318,172 A * 6/1994 Kenny et al. ..... 209/524
5,333,739 A * 8/1994 Stelte ..... 209/582
5,335,791 A 8/1994 Eason ..... 209/588
5,339,963 A 8/1994 Tao ..... 209/581
5,350,118 A * 9/1994 Mitchell et al. ..... 239/551
5,398,818 A 3/1995 McGarvey ..... 209/580
5,402,264 A 3/1995 Wilbur et al. ..... 359/508
5,419,438 A 5/1995 Squyres et al. ..... 209/3.1
5,440,127 A 8/1995 Squyres ..... 250/341.8
5,443,164 A 8/1995 Walsh et al. ..... 209/580
5,456,127 A * 10/1995 Gschweitl ..... 73/866
5,464,981 A 11/1995 Squyres et al. ..... 250/341.8
5,469,973 A 11/1995 Booth et al. ..... 209/580
5,481,864 A 1/1996 Wright ..... 57/400
5,483,057 A 1/1996 Gross et al. ..... 250/226
5,501,344 A 3/1996 Kaiser et al. ..... 209/578
5,512,758 A 4/1996 Kobayashi et al. ..... 250/461.1
5,531,331 A 7/1996 Barnett ..... 209/580
5,533,628 A 7/1996 Tao ..... 209/580
5,555,984 A * 9/1996 Sommer et al. ..... 209/580
5,590,791 A 1/1997 Gschweitl ..... 209/577
5,632,381 A 5/1997 Thust et al. ..... 209/44.1
5,675,416 A 10/1997 Campbell et al. ..... 356/367
5,782,364 A 7/1998 Macenka ..... 209/643
5,789,741 A 8/1998 Kinter et al. ..... 250/226
5,794,788 A * 8/1998 Massen ..... 209/524
5,799,105 A 8/1998 Tao ..... 382/167
5,813,542 A 9/1998 Cohn ..... 209/581
5,826,919 A * 10/1998 Bravo et al. ..... 285/139.2
5,848,706 A 12/1998 Harris ..... 209/580
5,862,919 A * 1/1999 Eason ..... 209/577
5,884,775 A 3/1999 Campbell ..... 209/581
5,894,938 A * 4/1999 Ichise et al. ..... 209/559
5,895,910 A 4/1999 Christian ..... 250/208.2
5,913,427 A 6/1999 Gschweitl ..... 209/10
5,954,206 A 9/1999 Mallon et al. ..... 209/580
5,966,217 A 10/1999 Roe et al. ..... 356/402
5,979,240 A 11/1999 Rix et al. ..... 73/602
6,011,229 A 1/2000 Geisler et al. ..... 209/127.4
6,112,903 A * 9/2000 Kimmel et al. ..... 209/11
6,137,074 A * 10/2000 Doak ..... 209/581
6,144,004 A 11/2000 Doak ..... 209/581
6,260,712 B1 7/2001 Flottman et al. ..... 209/639
6,265,683 B1 7/2001 Flottmann et al. ..... 209/576
6,313,422 B1 11/2001 Anibus ..... 209/580
6,504,124 B1 1/2003 Doak ..... 209/581
6,506,991 B1 1/2003 Eixelberger et al. ..... 209/581
2004/0035763 A1* 2/2004 Kokko ..... 209/638

* cited by examiner

METHOD OF AND APPARATUS FOR MULTI-STAGE SORTING OF GLASS CULLETS

RELATED APPLICATION

This patent application claims priority under 35 U.S.C. 119 (e) of the U.S. Provisional Patent Application Ser. No. 60/403,297 filed Aug. 12, 2002, and entitled "GLASS SORTER". The Provisional Patent Application Ser. No. 60/403,297 filed Aug. 12, 2002, and entitled "GLASS SORTER" is also hereby incorporated by reference.

FIELD OF THE INVENTION

The invention relates to a method and apparatus for sorting glass in general, and specifically, to a method and apparatus for sorting waste glass by color using a multi-stage sorter.

BACKGROUND OF THE INVENTION

Currently, there is a need to preserve natural resources and reduce dependence on landfills and similar waste storage facilities. To meet this need, several processes and machines are used to identify and sort waste materials, such as glass. Glass containers and other glass objects are recycled by first crushing or breaking the glass into glass cullets, which are small pieces of glass of varying characteristics that are distinguished by color. Prior to recycling, glass cullets of varying colors such as clear, green and brown, as well as combinations are placed on a conveyer belt and need to be separated and sorted.

U.S. Pat. No. 5,314,071 to Christian et al. teaches a method of purification and color sorting of waste glass as well as, a glass beneficiation process and apparatus. Christian et al. teach a method of sorting glass based on the transmission properties of the glass using red and green lamps. In addition, Christian et al. detail a method of using an actuator to deflect the trajectory of the glass. The deflection causes the glass to descend into one of two paths, which is the undeflected trajectory and the deflected trajectory. The specifics of the prior sorting system is taught and described in U.S. Pat. No. 5,314,071 to Christian et. al, which is hereby incorporated by reference.

As full scale beneficiation has become more prevalent, the disadvantages of the system and method taught in Christian et al. have been realized. First, the red and green lamps taught in Christian et al. limit the spectral response of the system. Glass entering the beneficiation plants contain shades of green, brown or blue that cannot be differentiated with a red and green lamp. The second disadvantage by the system taught in Christian et al., is that Christian et al. describe a means to deflect the trajectory of the descending glass with a single actuator, which is termed a binary sort. Therefore, the single actuator in Christian et al. performs several sorting stages to arrive at a pure material. Additional sorting stages add cost, energy and time to the equipment and sorting process.

A system and process which overcomes the limited spectral response equated with the red and green lamps is desirable. A system and process which utilizes multi stage sorting to increase the efficiency of the sorting system is also desirable.

SUMMARY OF THE INVENTION

One aspect of the present invention includes a system which sorts different colored objects, preferably glass cullets, into separate groups of same colored objects. The system comprises a plurality of sorting devices which receive an input feed of different colored objects and sort the different colored objects into a plurality of output feeds. At least one output feed in the plurality of output feeds is a subsequent input feed to one or more sorting devices in the plurality. The one or more sorting devices sort the at least one subsequent input feed into a plurality of further sorted output feeds. At least one of the plurality of sorting devices is a final sorting device, wherein the final sorting device sorts one or more subsequent input feeds into a plurality of final output feeds. At least one of the plurality of output feeds contains objects of a desired color, flint objects and/or undesired objects, whereby the undesired objects are directed to a rejection bin. The final sorting device directs each of the plurality of final output feeds into a plurality of corresponding storage bins. The sorting device sorts the received different cullets based on light transmission properties of the colored cullets. The sorting device further comprises a light emitting source which transmits at least one light of predetermined frequency through the glass cullet. The light emitting source includes one or more of a red light emitting diode, a green light emitting diode, a blue light emitting diode and an infrared light source. The sorting device further comprises a sensor module that is coupled to the light emitting source and configured to receive light transmitted through the glass cullet. The sorting device determines the color of the cullet from the at least one light received. The sorting device further comprises at least one actuator that is coupled to the sensor module, wherein the actuator directs the cullet to one of the plurality of output feeds depending on a signal provided by the sensor module.

Another aspect of the invention includes a method of effectively sorting a group of different colored objects, preferably glass cullets, into separate groups of similar colored objects. The method comprises the steps of receiving an input feed having a plurality of objects; and sorting the input feed into a plurality of output feeds. At least one output feed in the plurality of output feeds serves as a subsequent input feed. The method further includes the step of further sorting the at least one subsequent input feed into a plurality of subsequent output feeds. The method further comprises the step of receiving at least one of the plurality of subsequent output feeds and sorting the received the at least one subsequent output feeds into a plurality of final output feeds. The method further comprises the step of directing each of the plurality of final output feeds into a plurality of means for storing. At least one of the plurality of output feeds contains undesired objects, wherein the undesired objects are directed to a rejection bin. In addition, the output feeds contain flint objects and objects of a desired color. The cullets are sorted based on light transmission properties of the colored cullets, whereby at least one light of predetermined frequency is emitted through the cullet, and the light transmitted through the cullet is sensed, thereby determining a color characteristic of the cullet. The light includes one or more of a red light emitting diode, a green light emitting diode, a blue light emitting diode and an infrared light source. The method further comprises the step of directing the cullet to one of the plurality of output feeds depending on the color characteristic determined.

Another aspect of the invention is directed to a method of effectively sorting different colored objects, preferably glass cullets, into a plurality of groups of objects which have a similar desired quality. The method comprises the steps of providing a plurality of sorting devices. Each sorting device receives a mixture of objects of different qualities and separates the different received objects into a plurality of output feeds. Each output feed has objects of a substantially similar quality. The method includes configuring the plurality of sorting devices such that at least one output feed in each of one or more sorting devices in the plurality is input into a corresponding subsequent sorting device. The one or more sorting devices sort at least one received subsequent output feed into a plurality of further sorted output feeds. At least one of the plurality of sorting devices is a final sorting device, wherein the final sorting device sorts at least one received subsequent output feed into a plurality of final output feeds. The final sorting device directs each of the plurality of final output feeds into a corresponding storage bin. The method further includes the step of configuring a rejection bin to store at least one of the plurality of output feeds containing undesired objects. At least another one of the plurality of output feeds contains flint objects. Another output feed contains objects of a desired color. The sorting device sorts the received glass cullets based on light transmission properties of the glass cullets. The sorting device further comprises means for transmitting at least one light of predetermined frequency through the glass cullet. The light includes one or more of a red light emitting diode, a green light emitting diode, a blue light emitting diode and an infrared light source. The sorting device further comprises means for sensing light transmitted through the glass cullet, wherein the sorting device determines the color of the glass cullet from the light sensed. The sorting device further comprises means for actuating coupled to the means for sensing, wherein the means for actuating directs the glass cullet to one of the plurality of output feeds depending on a signal provided by the means for sensing.

Another aspect of the present invention includes a multi-level sorting system which separates different colored cullets into cullets having substantially similar color characteristics. The system comprises a first means for sorting the cullets. The first means for sorting directs the sorted cullets into a plurality of first output paths. The system includes a second means for further sorting at least one received first output path. The second means for sorting directs the further sorted cullets into a plurality of second output paths. The system includes a third means for subsequently sorting at least one received first output path and at least one received second output path. The third means for sorting directs the subsequently sorted cullets into a plurality of third output paths.

Another aspect of the invention includes a multi-level sorting system which separates a mixed stream of colored cullets into cullets having substantially similar color characteristics. The system comprises one or more first stage tri-sorters which sorting the cullets. The one or more first stage tri-sorters direct the sorted cullets into a plurality of first output paths. The system also includes a second stage tri-sorter which is coupled to the one or more first stage tri-sorters. The second stage tri-sorter sorts the cullets from the received first output path from the one or more first stage tri-sorters, thereby forming second sorted cullets, wherein the second stage tri-sorter directs the second sorted cullets into a plurality of second output paths. The system includes a third stage tri-sorter which is coupled to the one or more first stage tri-sorters and the second stage tri-sorter. The third stage tri-sorter sorts the cullets from the received first output path of the one or more first stage tri-sorters and at least one received second output path, thereby forming third sorted cullets, wherein the third stage tri-sorter directs the third sorted cullets into a plurality of third output paths.

DETAILED DESCRIPTION OF THE PRESENT INVENTION

Figure 1:
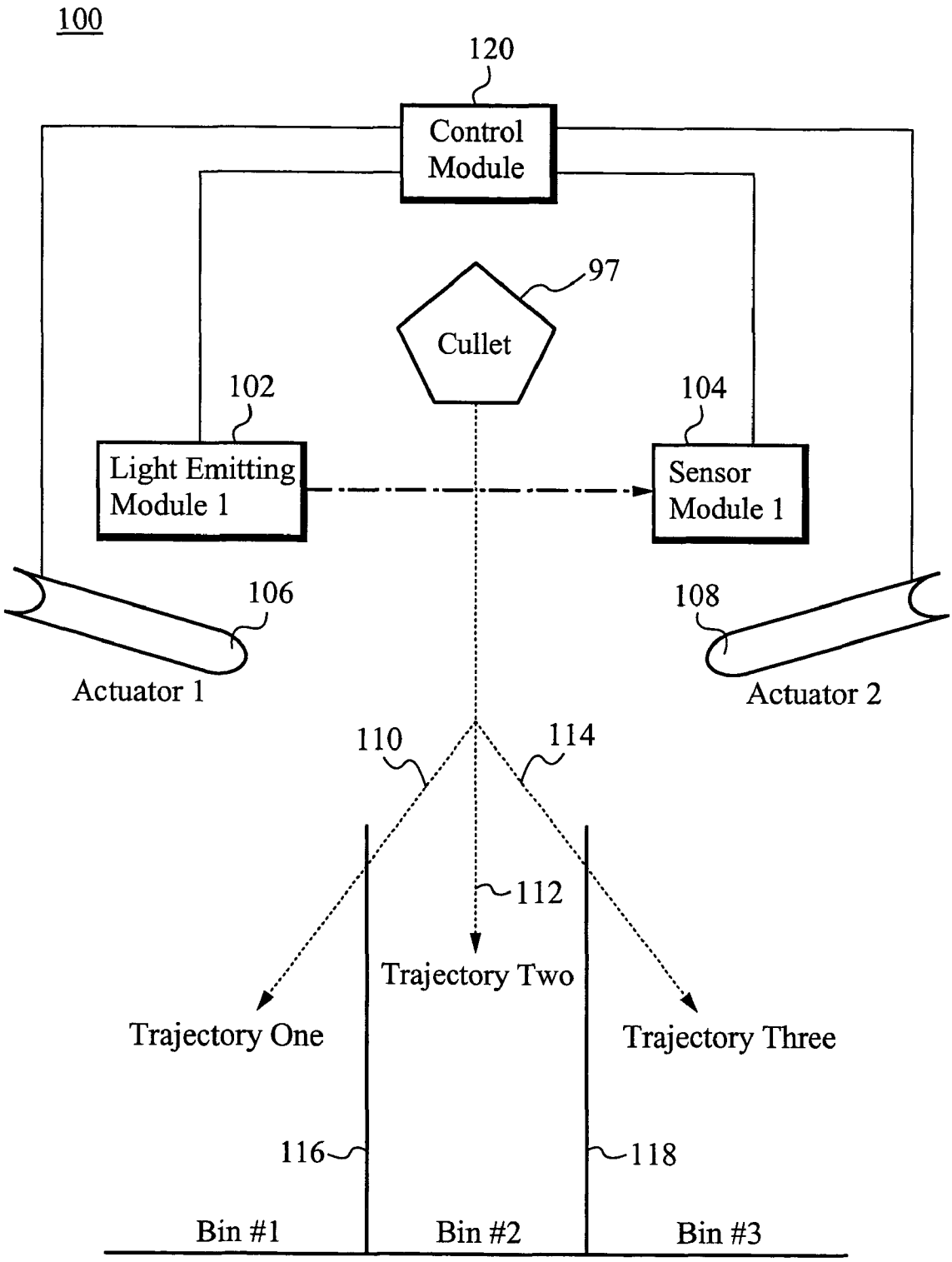
FIG. 1 illustrates a schematic of the preferred embodiment of the tri-sorting mechanism in accordance with the present invention.

FIG. 1 illustrates a schematic of the preferred embodiment of the tri-sorting apparatus 100 in accordance with the present invention. As shown in FIG. 1, the tri-sorter device 100 preferably includes a light emitting module 102 coupled to a sensor module 104, whereby the light emitting module 102 and the sensor module 104 are positioned opposite from one another on either side of the initial path of the cullet 97. The tri-sorter device 100 also includes a first actuator 106 and a second actuator 108 which are preferably positioned opposite of one another on either side of the initial path of the cullet 97. A control module 120 is coupled to the light emitting module 102, the sensor module 104, the first actuator 106 and the second actuator 108. It is apparent to one skilled in the art that the other components of the system not shown in FIG. 1 are contemplated and the design of the tri-sorter 100 of the present system is not limited thereto. Within the sorting device 100, the glass cullet 97 is directed along one of three trajectory paths 110, 112 and 114 depending on the color of the cullet 97 as detected by the sensor module 104. Thus, the particular trajectory path that the cullet is directed to is determined by the transmission properties of the cullet as well as the color sensed by the sensor module 104. The trajectory paths lead the cullets 97 into bins, shown in FIGS. 1-3. The bins in FIG. 1 are separated by mechanical separators 116, 118.

The cullet 97 preferably falls vertically between the light emitting module 102 and the sensor module 104. The light emitting module 102 preferably includes four light sources, although any number of light sources are alternatively used. Preferably, the light emitting module 102 includes a red light source, a green light source, a blue light source and an infrared light source. The light source is preferably a light emitting diode or LED, however any other type of light source is contemplated. Alternatively, any other appropriate light source or combination of light sources is used as the light source within the light emitting module 102. A control module 120 is coupled to the light emitting module 102 and controls each of the four light sources to emit light sequentially and at regular intervals.

The light emitted from the light emitting module 102 is transmitted through the cullet 97 as the cullet 97 falls between the light emitting module 102 and sensor module 104. The sensor module 104 receives and senses the light transmitted through the cullet 97. The control module 120 is coupled to the sensor module 104 and determines the color of the cullet 97 based on the attenuated levels of light observed at the sensor module 104 and compared to stored non-attenuated levels. The details of the operation of the sensor module in conjunction with the control module to detect transmission properties and colors of glass are well known in the art and will not be discussed in detail herein. Once the color of the passing glass cullet 97 is identified, the control module 120 activates the corresponding actuator 106, 108 to deflect the cullet 97 into the desired trajectory path or does not activate either of the actuators 106, 108 and lets the cullet 97 fall along the initial trajectory path 112.

For instance, if the cullet 97 is identified by the sensor and is to be directed into bin #3, the control module 120 will activate the first actuator 106 to blow air at and thereby deflect the passing cullet 97 to the trajectory path 114. Similarly, if the cullet 97 is identified by the sensor to be directed into bin #1, the control module 120 will activate the second actuator 108 to blow air at and thereby deflect the passing cullet 97 to the trajectory path 110. Additionally, if the cullet 97 is identified by the sensor to be directed into bin #2, the control module 120 will not activate either actuator 106, 108, and the cullet 97 will fall undisturbed down the initial trajectory path 112. In alternative embodiments, each tri-sorter alternatively has any number of light emitting modules 102, sensor modules 104, control modules 120 and actuators 106.

The sorting system of the present invention has a number of component subsystems that work in conjunction with one another to effectively sort and filter the array of mixed glass cullets into bins, whereby each bin has a collection of substantially same colored cullets. It is apparent to one skilled in the art that the preprocessing and preparation stages are incorporated into the present system. The preprocessing and preparation stages preferably include glass crushing, a glass washing, sifting and sorting preparation. A sifter (not shown) preferably removes the small undesirable shards of glass from the cullets that are to be sorted. A vibratory feeder (not shown) preferably prepares the cullets for sorting by providing adequate spacing between each glass cullet such that the system has sufficient time to analyze and sort each glass cullet. In addition, conventional transport means, such as conveyer belts, preferably deliver the cullets to the locations where the cullets are processed. The details of the preprocessing stages are well known in the art and are not discussed in any further detail herein.

Figure 2:
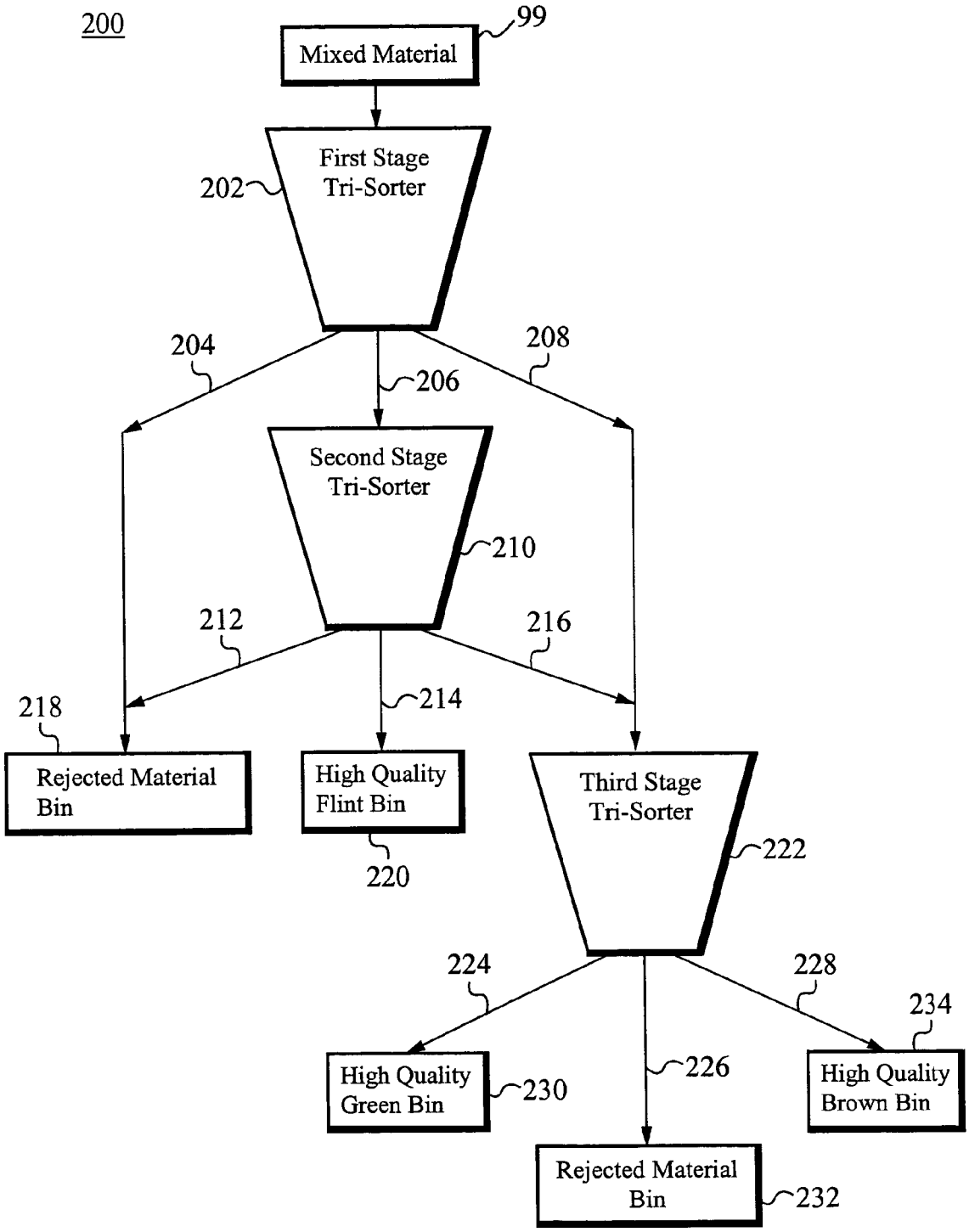
FIG. 2 illustrates a three stage glass sorting system with tri-sorter mechanism in accordance with the present invention.

FIG. 2 illustrates a three stage glass sorting system 200 with multiple tri-sorter mechanisms in accordance with the present invention. As shown in FIG. 2, the sorting system 200 includes a first stage tri-sorter 202 coupled to a second stage tri-sorter 210. The first stage tri-sorter 202 and the second stage tri-sorter 210 are coupled to a rejected material bin 218 and a third stage tri-sorter 222. In addition, the second stage tri-sorter 210 is coupled to a high quality flint bin 220. The third stage tri-sorter 222 is coupled to a high quality green cullet bin 230, a poor quality flint bin 232 and a high quality brown cullet bin 234.

Figure 4:
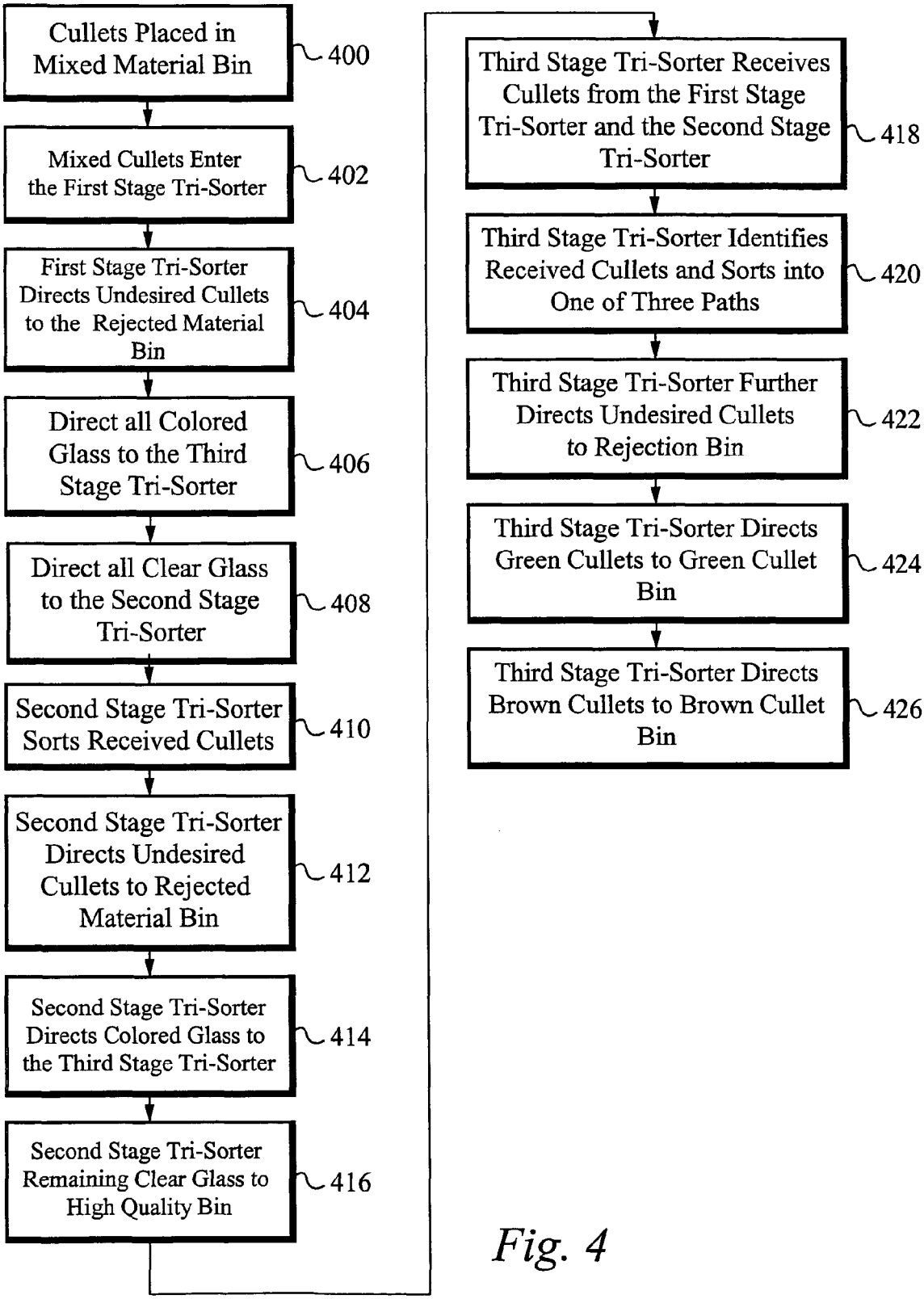
FIG. 4 illustrates a flow chart of the sorting method in the three stage glass sorting system of the present invention.

The operation of the three stage sorting system 200 of the present invention will now be discussed in conjunction with the flow chart illustrated in FIG. 4. In particular, crushed glass is placed in the mixed material bin 99 at the step 400. It should be noted that the objects in the mixed material bin 99 preferably undergo preprocessing procedures discussed above before being placed in the mixed material bin 99. The cullets are transported via a transporting mechanism, such as a conveyer belt, from the mixed material bin 99 and fed into the first stage tri-sorter 202 at the step 402. The transport mechanism used to deliver the cullets to the mixed material bin 99 can be any appropriate conventional type used or known in the art and is not discussed in detail herein.

The first stage tri-sorter 202 operates in the manner discussed above and deflects the cullets into one of three deflection or trajectory paths, 204, 206, 208. Using the preferred identification process discussed above, the first stage tri-sorter 202 deflects all the cullets identified as having undesirable characteristics into the deflection path 204. The undesired materials are thus deflected and fall into the rejected material bin 218 at the step 404. Such undesirable characteristics or materials include, but are not limited to, opaque materials, ceramics, and glass with labels. It is apparent to one skilled in the art that any other materials can be identified as undesirable.

The first stage tri-sorter 202 also deflects all cullets identified as having green characteristics as well as cullets identified as having brown characteristics into deflection path 208 from the mixed input at the step 406. Therefore, all the green and brown glass is deflected and directed via a conventional transport mechanism to the third stage tri-sorter 222 for further processing, as discussed below. The first stage tri-sorter 202 also directs all cullets identified as having clear characteristics to path 206, whereby the clear or flint glass is directed to the second stage tri-sorter 210, at the step 408, via a conventional transport mechanism. Preferably, the clear or flint glass is allowed to fall undeflected, whereby no actuation is applied to the flint glass by the first stage tri-sorter 202. Alternatively, instead of allowing the cullet to fall undeflected, the identified clear glass is actuated and is deflected in a desired angled trajectory such as paths 204 or 208.

The second stage tri-sorter 210 receives the cullets fed into the path 206 from the first stage tri-sorter 202 at the step 410. In the present example, the majority of cullets fed into the second stage tri-sorter 210 have clear characteristics due to the operation performed by the first stage tri-sorter 202. Upon receiving the cullets from path 206, the second stage tri-sorter 210 identifies the received sorted cullets and further sorts and directs the identified cullets into one of the three trajectory paths, 212, 214, 216. Using the preferred identification process discussed above, the second stage tri-sorter 210 deflects all cullets identified as having undesirable characteristics into the deflection path 212. The undesired materials are deflected and fall into the rejected material bin 218 at the step 412. Such undesirable characteristics or materials are mentioned above and any materials can be programmed to be identified as undesirable.

The second stage tri-sorter 210 also deflects all cullets identified as having green characteristics as well as cullets identified as having brown characteristics into the deflection path 216 at the step 414. Therefore, all green and brown glass cullets are deflected from the second stage tri-sorter 210 and directed to the third stage tri-sorter 222 via a conventional transport mechanism for further processing, as discussed below. The second stage tri-sorter 210 also directs all cullets identified as having clear characteristics to path 214, whereby the clear flint glass is directed to the high quality flint bin 220 at the step 416. Preferably, the flint cullets are allowed to fall undeflected, whereby no actuation is applied to the flint cullets by the second stage tri-sorter 210. Alternatively, the identified clear flint cullets are actuated and are deflected in a desired trajectory, such as the paths 212 or 216. Therefore, the second stage tri-sorter 210 further sorts the cullets identified and sorted by the first stage tri-sorter 202. In this example, the second stage tri-sorter 210 sorts the remaining clear flint cullets out from the mixed material cullets into bin 220. It should be noted that although the clear flint cullets are separated out completely by the second stage tri-sorter 210, it is apparent that any other desired glass can be completely sorted by the second stage tri-sorter, instead of clear flint cullets.

The third or final stage tri-sorter 222 shown in FIG. 2 receives the cullets directed along the path 208 from the first stage tri-sorter 202 at the step 418. In addition, the third stage tri-sorter 222 receives the cullets directed along the path 216 from the second stage tri-sorter 210 at the step 418. Preferably, the cullets received by the third stage tri-sorter 222 along the paths 208 and 216 are mixed green and brown cullets. In the present example, the majority of cullets fed into the third stage tri-sorter 222 have green and/or brown characteristics due to the operation performed by the first and second stage tri-sorters 202, 210. However, the third stage tri-sorter may receive any other output feed of cullets from the first and/or second stage tri-sorter 202, 210. Upon receiving the mixed cullets from the paths 208 and 216, the third stage tri-sorter 222 identifies the received cullets and sorts the identified cullets into one of the three trajectory paths, 224, 226 and 228 at the step 420. Using the preferred identification process discussed above, the third stage tri-sorter 222 deflects all cullets identified as having undesirable characteristics into the path 226, whereby the undesired cullets are directed to the rejection bin 232 at the step 422. Such undesirable characteristics or materials are mentioned above and any of the received materials can be programmed into the third stage tri-sorter to be identified and sorted as undesirable.

The third stage tri-sorter 222 also identifies and sorts all cullets identified as having green characteristics into the deflection path 224, whereby the deflected green cullets are sent to the high quality green cullet bin 230 at the step 424. The third stage tri-sorter identifies and deflects all cullets identified as having brown characteristics into the deflection path 228, whereby the deflected brown cullets are sent to the high quality brown cullet bin 234 at the step 426. Therefore, the third stage tri-sorter 222 further sorts the cullets already identified and sorted by the first and second stage tri-sorters 202, 210, whereby the third stage tri-sorter 222 completely filters the green and brown cullets out from the mixed material. The multi-stage system 200 of the present invention thereby provides a more thorough sorting operation than previous sorting systems. Accordingly, the system 200 of the present invention utilizes subsequent sorting devices to further sort the output from preceding sorting devices, whereby the subsequent sorting devices direct the cullets into bins to have a homogenous collection of colored cullets. This allows each tri-sorter within the multi-stage system 200 to be optimized to sort glass with particular characteristics. For example, within the multi-stage system 200 of FIG. 2, the second stage tri-sorter 210 is optimized to sort clear flint glass and the third stage tri-sorter 222 is optimized to sort green and brown glass.

Figure 3:
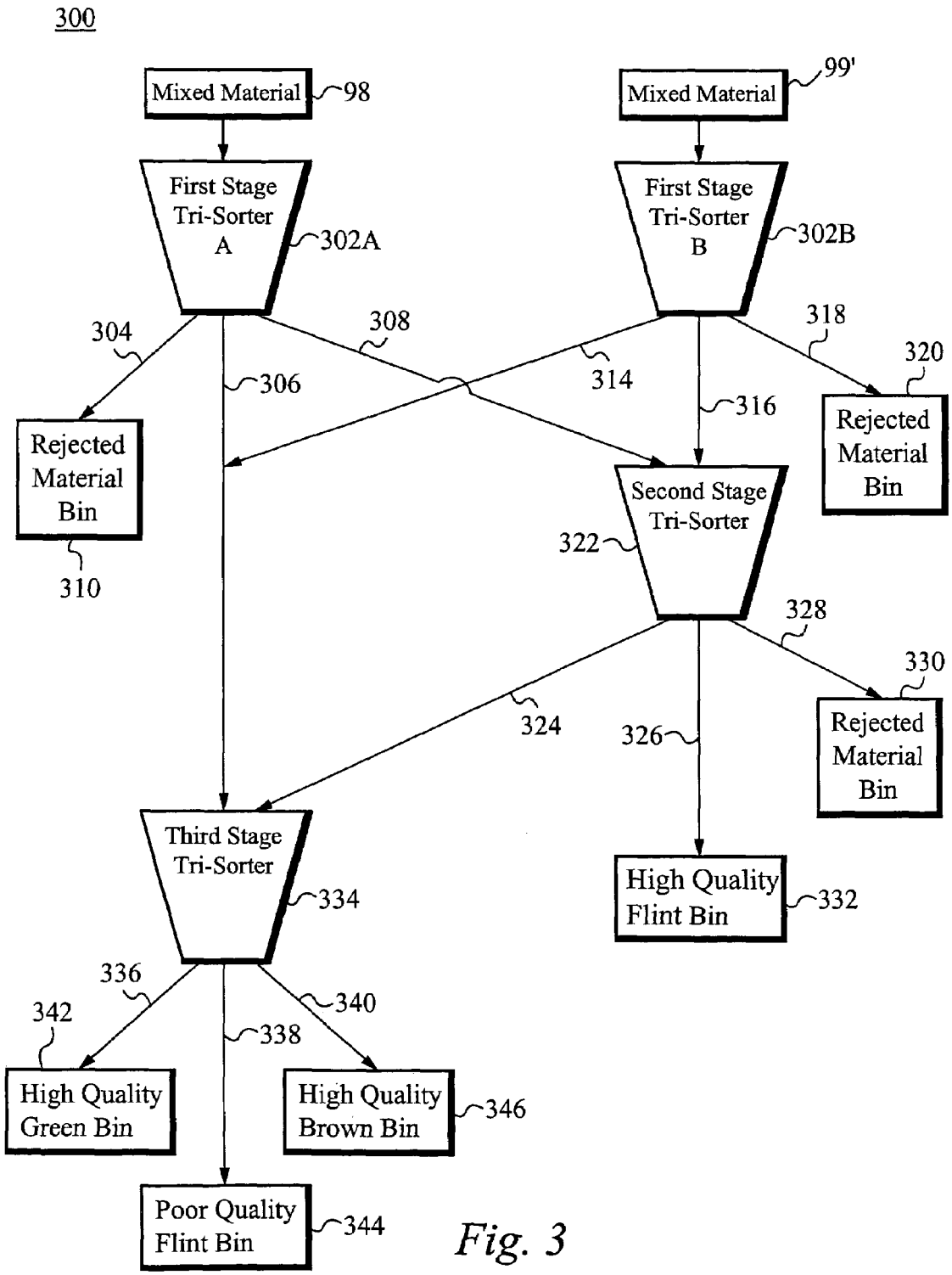
FIG. 3 illustrates a four stage glass sorting system with tri-sorter mechanism in accordance with the present invention.

FIG. 3 illustrates a four stage glass sorting system 300 with multiple tri-sorter mechanisms in accordance with the present invention. As shown in FIG. 3, the sorting system 300 includes a first stage tri-sorter A 302A and a first stage tri-sorter B 302B which preferably operate simultaneously with the other tri-sorters in the system 300. The first stage tri-sorter A 302A is coupled to a rejection bin 310, a second stage tri-sorter 322 and a third stage tri-sorter 334. The first stage tri-sorter B 302B is coupled to the third stage tri-sorter 334, the second stage tri-sorter 322 as well as a rejection bin 320. The second stage tri-sorter 322 is coupled to the third stage tri-sorter 334, a high quality flint bin 332 and a rejection bin 330. The third stage tri-sorter 334 is coupled to a high quality green cullet bin 342, a rejection or poor quality flint bin 344 and a high quality brown cullet bin 346.

Figure 5:
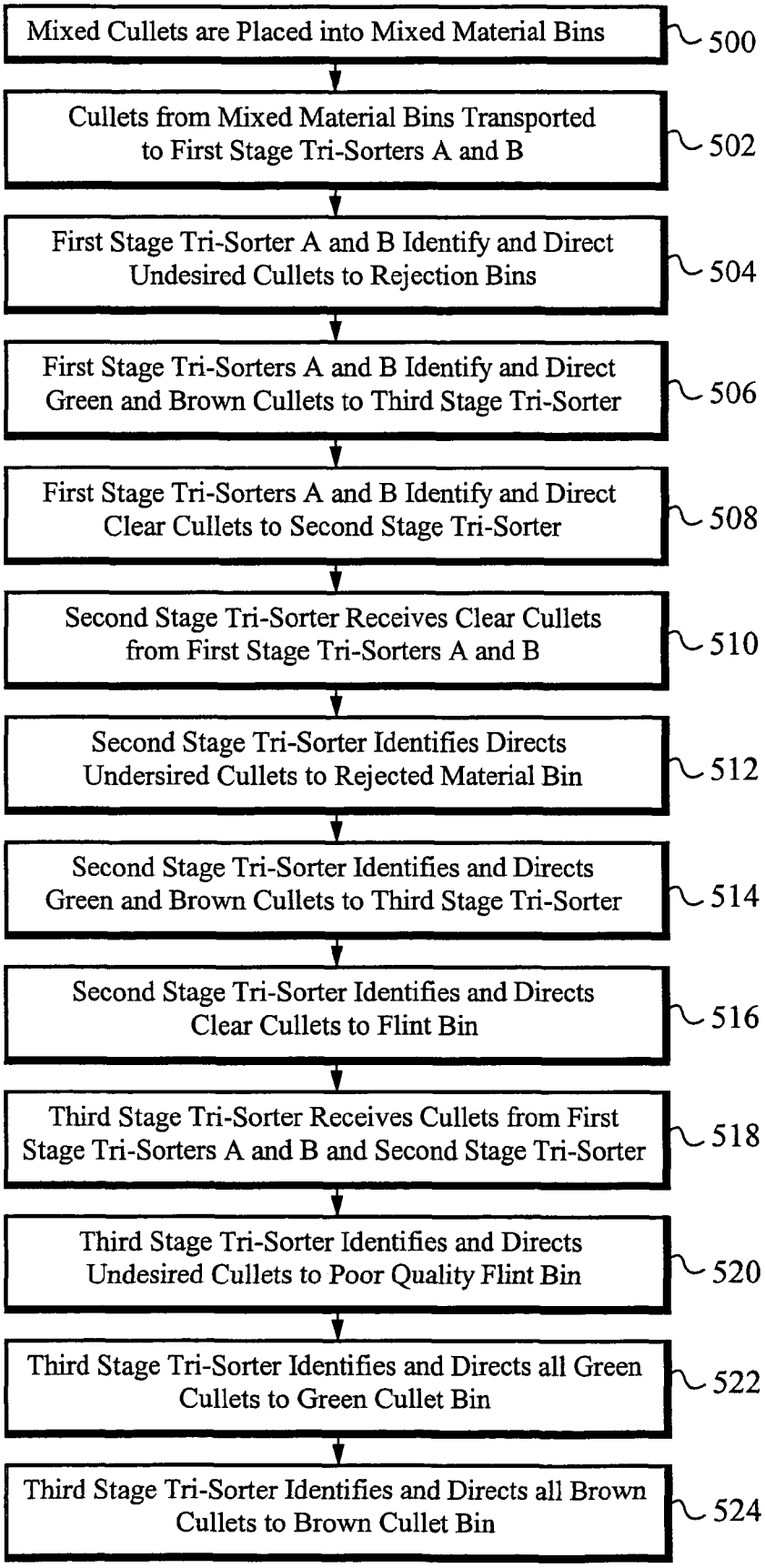
FIG. 5 illustrates a flow chart of the sorting method in the four stage glass sorting system of the present invention.

The operation of the four stage sorting system 300 of the present invention will now be discussed in conjunction with the flow chart illustrated in FIG. 5. In particular, crushed cullets or pieces, such as opaque, ceramics, glass with labels as well as colored glass, are placed in two mixed material bins 98 and 99' at the step 500. It should be noted that the cullets in the mixed material bins 98, 99' preferably undergo preprocessing procedures discussed above before being placed in the mixed material bins 98, 99'. The cullets from the mixed material bin 98 are transported via a transporting mechanism to the first stage tri-sorter A 302A at the step 502. In addition, cullets from the mixed material bin 99' are transported via a transporting mechanism to the first stage tri-sorter B 302B at the step 502. As stated above, the transport mechanism can be any appropriate conventional type used or known in the art and is not discussed in detail herein.

The first stage tri-sorter A 302A deflects the cullets into one of three deflection or trajectory paths, 304, 306, 308. Using the preferred identification process discussed above, the first stage tri-sorter A 302A deflects all cullets identified as having undesirable characteristics to the deflection path 304 and into the rejected material bin 310 (step 504). The first stage tri-sorter A 302A directs all cullets identified as having green characteristics as well as cullets identified as having brown characteristics into the path 306, whereby the cullets in path 306 are directed to the third stage tri-sorter 334 at the step 506. Thus, all green and brown glass is directed to the third stage tri-sorter 334 via a conventional mechanism for further processing, as discussed below. Preferably, the green and brown cullets are allowed to fall along the path 306 undeflected, whereby no actuation is applied to the cullets by the first stage tri-sorter A 302A. Alternatively, instead of allowing the cullets to fall undeflected, the identified cullets are actuated by the first stage tri-sorter A 302A and are deflected in a desired trajectory such as paths 304 or 308. The first stage tri-sorter A 302A also directs all cullets identified as having clear characteristics to path 308, whereby the clear or flint glass is directed to the second stage tri-sorter 322, at the step 508 via a conventional transport mechanism.

Preferably, the first stage tri-sorter B 302B simultaneously operates along with first stage tri-sorter A 302A. The cullets to be sorted are transported via a transporting mechanism from the mixed material bin 99' to the first stage tri-sorter B 302B at the step 502. As stated above, the transport mechanism can be any appropriate conventional type used or known in the art and is not discussed in detail herein. The first stage tri-sorter B 302B deflects the cullets into one of three deflection or trajectory paths, 314, 316, 318. Using the preferred identification process discussed above, the first stage tri-sorter B 302B deflects all cullets identified as having undesirable characteristics to the deflection path 318 and into the rejected material bin 320 at the step 504. The first stage tri-sorter B 302B directs all cullets identified as having green characteristics as well as cullets identified as having brown characteristics into the path 314 at the step 506. Thus, all sorted green and brown glass is directed from the first stage tri-sorter B 302B to the third stage tri-sorter 334 via a conventional mechanism for further processing, as discussed below. The first stage tri-sorter B 302B also directs all cullets identified as having clear characteristics to the path 316, whereby the clear or flint glass is directed to the second stage tri-sorter 322 (step 508) via a conventional transport mechanism. Preferably, the flint cullets are allowed to fall undeflected along the trajectory path 316, whereby no actuation is applied to the cullets by the first stage tri-sorter B 302B. Alternatively, instead of allowing the flint cullets to fall undeflected, the identified flint cullets are actuated by the first stage tri-sorter B 302B to a desired trajectory such as paths 314 or 318.

The second stage tri-sorter 322 receives the cullets directed along the path 308 from the first stage tri-sorter A 302A and along the path 316 from the first stage tri-sorter B 302B at the step 510. Upon receiving the cullets from the paths 308 and 316, the second stage tri-sorter 322 identifies the received cullets and further sorts and directs the identified cullets into one of three paths, 324, 326 and 328. Using the preferred identification process discussed above, the second stage tri-sorter 322 deflects all cullets identified as having undesirable characteristics along the deflection path 328. The details of the undesirable cullets are mentioned above. The undesired materials that are deflected into the path 328 fall into the rejected material bin 330 at the step 512.

The second stage tri-sorter 322 also deflects all cullets identified as having green characteristics as well as cullets identified as having brown characteristics into the deflection path 324 at the step 514. Therefore, all green and brown glass is deflected from the second stage tri-sorter 322 to the third stage tri-sorter 334 via a conventional transport mechanism for further processing, as discussed below. In the present example, the majority of cullets fed into the second stage tri-sorter 322 have clear characteristics from the sorting operation performed by the first stage tri-sorters A and B 302A, 302B. The second stage tri-sorter 322 also directs all cullets identified as having clear characteristics to path 326, whereby the flint glass is directed to the high quality flint bin 332 at the step 516. Preferably, the flint cullets are allowed to fall undeflected along the trajectory path 326, whereby no actuation is applied to the flint cullets by the second stage tri-sorter 322. Alternatively, the identified clear glass is actuated and is deflected in a desired trajectory path such as paths 324 or 330. Thus, the second stage tri-sorter 322 further sorts the cullets already identified and sorted by the first stage tri-sorters A and B 302A, 302B, thereby completely separating the flint cullets from the mixed collection.

The third or final stage tri-sorter 334 shown in FIG. 3 receives the cullets directed along the paths 306, 314 and 324 from the first stage tri-sorters A and B 302A, 302B and second stage tri-sorter 322, respectively at the step 518. Preferably, the cullets received in the third stage tri-sorter 334 along the paths 306, 314 and 324 are mixed green and brown cullets. In the present example, the majority of cullets fed into the third stage tri-sorter 334 have green and/or brown characteristics due to the operation performed by the first stage tri-sorters A and B 302A, 302B as well as the second stage tri-sorter 322. Upon receiving the green and brown cullets directed along the paths 306, 314 and 324, the third stage tri-sorter 334 further identifies and sorts the identified cullets into one of the three paths, 336, 338 and 340. Using the preferred identification process discussed above, the third stage tri-sorter 334 allows all cullets identified as having undesirable characteristics to fall along the path 338 at the step 520, whereby the undesired cullets are directed to the rejected bin 344. Alternatively, instead of allowing the undesired cullets to fall undeflected, the undesired cullets are actuated to a desired trajectory such as paths 336 or 340.

The third stage tri-sorter 334 also identifies and sorts all cullets identified as having green characteristics into the deflection path 336, whereby the deflected green cullets are sent to the high quality green cullet bin 342 at the step 522. In addition, the third stage tri-sorter 334 identifies and deflects all cullets identified as having brown characteristics into the deflection path 340, whereby the deflected brown cullets are sent to the high quality brown cullet bin 346 at the step 524. Therefore, the third stage tri-sorter 334 further sorts the cullets already identified and sorted by the first and second stage tri-sorters 302A, 302B and 322, thereby completely separating all the green and brown cullets into their respective bins. Accordingly, the system 300 of the present invention utilizes subsequent sorting devices to further sort the output from preceding sorting devices, whereby the subsequent sorting devices direct the cullets into bins to have a homogenous collection of colored cullets. This allows for optimization of the sorting characteristics of each tri-sorter stage within the multi-stage system 300.

The scalability of the present sorting system allows for any volume of cullets. Although the multi-sorting system described above is preferably utilized for glass cullets, it is apparent to one skilled in the art that the system is alternatively used to sort other objects. It is understood by one skilled in the art that any number of tri-sorters are utilized in the system to sort the cullets into any number of bins. In addition, the tri-sorters in the system 200, 300 may be positioned in any other configuration with respect to one another and is not limited to the configurations shown in FIGS. 2 and 3. In addition, the tri-sorters can be configured such that the cullets are deflected along a path different than those shown in FIGS. 2 and 3. Further, it is understood that the tri-sorters may be positioned such that the undesired cullets are directed into one bin instead of multiple bins. For instance, the tri-sorters can be reconfigured or repositioned such that all the undesired cullets fall into one rejection bin, such as bin 344, instead of three rejection bins 310, 320, and 344. In addition, although the steps are shown in a particular order in regards to the flowcharts in FIGS. 4 and 5, it should be noted that each tri-sorter is identifying and sorting the cullets simultaneously.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A system for sorting a mixed stream of different colored objects into separate groups of same colored objects comprising:

a plurality of first stage sorting devices each for receiving an input feed of different colored objects and sorting the different colored objects into a plurality of first stage output feeds, wherein the plurality of first stage sorting devices operate simultaneously, and further wherein at least one of the plurality of sorting devices sorts the different colored objects into more than two output feeds;

a second stage sorting device configured to receive at least one of the first stage output feeds, thereby forming a second stage output feed; and a third stage sorting device configured to directly receive at least one of the first stage output feeds which bypass the second stage sorting device, and the second stage output feed, thereby forming a third stage output feed.

2. The system according to claim 1 wherein the second stage sorting devices sort the at least one first stage output feeds into a plurality of second stage output feeds.

3. The system according to claim 1, wherein the third stage sorting device sorts the at least one of the first stage output feeds and the second stage output feed into a plurality of third stage output feeds.

4. The system according to claim 3 wherein at least one of the third stage output feeds contains objects of a desired color.

5. The system according to claim 3 wherein at least one of the third stage output feeds contains undesired objects, wherein the undesired objects are directed to a rejection bin.

6. The system according to claim 5 wherein at least one of the third stage output feeds contains flint objects.

7. The system according to claim 3 wherein the third stage sorting device directs each of the plurality of third stage output feeds into a plurality of corresponding storage bins.

8. The system according to claim 1 wherein the objects are glass cullets.

9. The system according to claim 8 wherein each sorting device sorts the received different cullets based on light transmission properties of the colored cullets.

10. The system according to claim 9 wherein each sorting device further comprises a light emitting source for transmitting at least one light of predetermined frequency through the glass cullet.

11. The system according to claim 10 wherein each sorting device further comprises a sensor module coupled to the light emitting source and configured to receive light transmitted through the glass cullet, wherein the sorting device determines the color of the cullet from the at least one light received.

12. The system according to claim 10 wherein the light emitting source includes one or more of a red light emitting diode, a green light emitting diode, a blue light emitting diode and an infrared light source.

13. The system according to claim 11 wherein the sorting device further comprises at least one actuator coupled to the sensor module, wherein the at least one actuator directs the cullet to one of the output feeds depending on a signal provided by the sensor module.

14. The system according to claim 1 further comprising at least one actuator coupled for directing the object to one of the output feeds depending on a color characteristic of the object.

15. The system according to claim 10 wherein the light emitting source includes one or more of a red light source, a green light source, a blue light source and an infrared light source.

16. A method of effectively sorting a group of different colored objects into separate groups of similar colored objects comprising:

a. receiving an input feed having a plurality of objects;

b. sorting the input feed at a plurality of first stage sorting devices into a plurality of first stage output feeds, wherein sorting occurs simultaneously for the input feeds;

c. sorting at least one of the first stage output feeds at a second stage sorting device thereby forming a second output feed; and d. sorting at least one of the first stage output feeds received directly from a corresponding one of the first stage sorting devices, and the second stage output feed, at a third stage sorting device, thereby forming a third stage output feed.

17. The method according to claim 16 wherein the third stage sorting device sorts into a plurality of third stage output feeds.

18. The method according to claim 17 further comprising directing each of the plurality of third stage output feeds into a corresponding container.

19. The method according to claim 16 wherein at least one of the third stage output feeds contains undesired objects, wherein the undesired objects are directed to a rejection bin.

20. The method according to claim 16 wherein at least one of the third stage output feeds contains flint objects.

21. The method according to claim 16 wherein at least one of the third stage output feeds substantially contains objects of a desired color.

22. The method according to claim 16 wherein the objects are glass cullets.

23. The method according to claim 22 wherein the cullets are sorted based on light transmission properties of the colored cullets.

24. The method according to claim 23 wherein sorting further comprises emitting at least one light of predetermined frequency through the cullet.

25. The method according to claim 24 wherein the at least one light includes one or more of a red light emitting diode, a green light emitting diode, a blue light emitting diode and an infrared light source.

26. The method according to claim 24 wherein sorting further comprises sensing light transmitted through the cullet and determining a color characteristic of the cullet from the light received.

27. The method according to claim 26 wherein sorting further comprises directing the cullet to one of the output feeds depending on the color characteristic determined.

28. The method according to claim 16 further comprising directing the object to one of the output feeds depending on a color characteristic of the object being determined.

29. The method according to claim 24 wherein the at least one light includes one or more of a red light source, a green light source, a blue light source and an infrared light source.

30. A method of effectively sorting different colored objects into a plurality of groups of objects having a similar desired quality, the method comprising:

a. providing a plurality of first stage sorting devices, wherein each first stage sorting device receives a mixture of objects of different qualities and separates the different received objects into two or more first stage output feeds, each first stage output feed having objects of a substantially similar quality, wherein the plurality of first stage sorting devices operate simultaneously, further wherein at least one of the plurality of first stage sorting devices sorts the different colored objects into more than two first stage output feeds;

b. sorting at least one of the first stage output feeds at a second stage sorting device thereby forming a second output feed; and c. sorting at least one of the first stage output feeds received directly from a corresponding one of the first stage sorting devices, and the second stage output feed, at a third stage sorting device, thereby forming a third stage output feed.

31. The method according to claim 30 wherein the third stage sorting device sorts the third stage sorting device sorts into a plurality of third stage output feeds.

32. The method according to claim 30 further comprising configuring a rejection bin to store at least one of the third stage output feeds containing undesired objects.

33. The method according to claim 32 wherein at least one of the third stage output feeds contains flint objects.

34. The method according to claim 33 wherein at least one of the third stage output feeds contains objects of a desired color.

35. The method according to claim 31 wherein the third stage sorting device directs each of the plurality of third stage output feeds into a corresponding storage bin.

36. The method according to claim 30 wherein the objects are glass cullets.

37. The method according to claim 36 wherein each sorting device sorts the received glass cullets based on light transmission properties of the glass cullets.

38. The method according to claim 37 wherein each sorting device further comprises means for transmitting at least one light of predetermined frequency through the glass cullet.

39. The method according to claim 38 wherein the at least one light includes one or more of a red light emitting diode, a green light emitting diode, a blue light emitting diode and an infrared light source.

40. The method according to claim 38 wherein each sorting device further comprises means for sensing light transmitted through the glass cullet, wherein each sorting device determines the color of the glass cullet from the light sensed.

41. The method according to claim 40 wherein each sorting device further comprises means for actuating coupled to the means for sensing, wherein the means for actuating directs the glass cullet to one of the output feeds depending on a signal provided by the means for sensing.

42. The method according to claim 30 wherein each sorting device further comprises means for directing the object to one of the output feeds depending on a color characteristic of the object.

43. The method according to claim 38 wherein the at least one light includes one or more of a red light source, a green light source, a blue light source and an infrared light source.

44. A multi-level sorting system for separating different colored cullets into cullets having substantially similar color characteristics comprising:

a. a first means for sorting the cullets, wherein the first means for sorting directs the sorted cullets into more than two first output paths;

b. a second means for further sorting at least one received first output path, wherein the second means for sorting directs the further sorted cullets into more than two second output paths; and c. a third means for subsequently sorting at least one received first output path received directly from the first means for sorting, and at least one received second output path, wherein the third means for sorting directs the subsequently sorted cullets into more than two output paths, wherein the first means, the second means and the third means for sorting sort cullets simultaneously.

45. A multi-level sorting system for separating a mixed stream of colored cullets into cullets having substantially similar color characteristics comprising:

a. a first stage tri-sorter for sorting the cullets, wherein the first stage tri-sorter directs the sorted cullets into a plurality of first stage output paths;

b. a second stage tri-sorter coupled to the first stage tri-sorter, the second stage tri-sorter for sorting cullets in at least one received first stage output path, thereby forming a second set of sorted cullets, wherein the second stage tri-sorter directs the second set of sorted cullets into a plurality of second stage output paths;

c. a third stage tri-sorter coupled to the first and second stage tri-sorters, the third stage tri-sorter for sorting cullets in at least one received first stage output path received directly from the first stage tri-sorter, and at least one received second stage output path, thereby forming a third set of sorted cullets, wherein the third stage tri-sorter directs the third set of sorted cullets into a plurality of third stage output paths; wherein at least one of the first, second, and third stage tri-sorters has more than two output paths, wherein the first stage tri-sorter, the second stage tri-sorter and the third stage tri-sorter sort cullets simultaneously.

46. The multi-level sorting system according to claim 45 wherein cullets in one of the plurality of first stage output paths are sent to a rejected material bin.

47. The multi-level sorting system according to claim 45 wherein cullets in one of the plurality of second stage output paths are sent to a rejected material bin.

48. The multi-level sorting system according to claim 45 wherein cullets in one of the plurality of second stage output paths are sent to a high quality flint cullet bin.

49. The multi-level sorting system according to claim 45 wherein cullets in one of the plurality of third stage output paths are sent to a high quality green cullet bin.

50. The multi-level sorting system according to claim 45 wherein cullets in one of the plurality of third stage output paths are sent to a rejected material bin.

51. The multi-level sorting system according to claim 45 wherein cullets in one of the plurality of third stage output paths are sent to a high quality brown cullet bin.

52. The multi-level sorting system according to claim 45 wherein each sorting device sorts the received cullets based on light transmission properties of the colored cullets.

53. The multi-level sorting system according to claim 52 wherein each sorting device further comprises a light emitting source for transmitting at least one light of predetermined frequency through the glass cullet.

54. The multi-level sorting system according to claim 53 wherein each sorting device further comprises a sensor module coupled to the light emitting source and configured to receive light transmitted through the glass cullet, wherein the sorting device determines the color of the cullet from the at least one light received.

55. The multi-level sorting system according to claim 54 wherein the light emitting source includes one or more of a red light emitting diode, a green light emitting diode, a blue light emitting diode and an infrared light source.

56. The multi-level sorting system according to claim 54 wherein each sorting device further comprises at least one actuator coupled to the sensor module, wherein the at least one actuator directs the cullet to one of the plurality of output feeds depending on a signal provided by the sensor module.

57. The multi-level sorting system according to claim 45 further comprising at least one actuator coupled for directing the cullet to one of the plurality of output feeds depending on a color characteristic of the cullet.

58. The multi-level sorting system according to claim 54 wherein the light emitting source includes one or more of a red light source, a green light source, a blue light source and an infrared light source.

59. A multi-level sorting system for separating a mixed stream of colored cullets into cullets having substantially similar color characteristics comprising:

a. a plurality of first stage tri-sorters for sorting the cullets, wherein the plurality of first stage tri-sorters direct the sorted cullets into a plurality of first output paths;

b. a second stage tri-sorter coupled to the plurality of first stage tri-sorters, the second stage tri-sorter for sorting cullets in at least one received first output path from each first stage tri-sorter, thereby forming second sorted cullets, wherein the second stage tri-sorter directs the second sorted cullets into a plurality of second output paths; and c. a third stage tri-sorter coupled to the plurality of first stage tri-sorters and the second stage tri-sorter, the third stage tri-sorter for sorting cullets in at least one received first output path received directly from each of the plurality of first stage tri-sorters and at least one received second output path, thereby forming third sorted cullets, wherein the third stage tri-sorter directs the third sorted cullets into a plurality of third output paths, wherein the plurality of first stage tri-sorters, the second stage tri-sorter and the third stage tri-sorter sort simultaneously.

60. The multi-level sorting system according to claim 59 wherein cullets in one of the plurality of first output paths from each first stage tri-sorter are sent to one or more rejected material bins.

61. The multi-level sorting system according to claim 59 wherein cullets in one of the plurality of second output paths are sent to a rejected material bin.

62. The multi-level sorting system according to claim 59 wherein cullets in one of the plurality of second output paths are sent to a high quality flint cullet bin.

63. The multi-level sorting system according to claim 59 wherein cullets in one of the plurality of third output paths are sent to a high quality green cullet bin.

64. The multi-level sorting system according to claim 59 wherein cullets in one of the plurality of third output paths are sent to a rejected material bin.

65. The multi-level sorting system according to claim 59 wherein cullets in one of the plurality of third output paths are sent to a high quality brown cullet bin.

66. The multi-level sorting system according to claim 59 wherein each sorting device sorts the received cullets based on light transmission properties of the colored cullets.

67. The multi-level sorting system according to claim 66 wherein each sorting device further comprises a light emitting source for transmitting at least one light of predetermined frequency through the glass cullet.

68. The multi-level sorting system according to claim 67 wherein each sorting device further comprises a sensor module coupled to the light emitting source and configured to receive light transmitted through the glass cullet, wherein the sorting device determines the color of the cullet from the at least one light received.

69. The multi-level sorting system according to claim 68 wherein the light emitting source includes one or more of a red light emitting diode, a green light emitting diode, a blue light emitting diode and an infrared light source.

70. The multi-level sorting system according to claim 68 wherein each sorting device further comprises at least one actuator coupled to the sensor module, wherein the at least one actuator directs the cullet to one of the plurality of output feeds depending on a signal provided by the sensor module.

71. The multi-level sorting system according to claim 59 further comprising at least one actuator coupled for directing the cullet to one of the plurality of output feeds depending on a color characteristic of the cullet.

72. The multi-level sorting system according to claim 68 wherein the light emitting source includes one or more of a red light source, a green light source, a blue light source and an infrared light source.

73. A multi-level sorting system for separating a mixed stream of colored cullets into cullets having substantially similar color characteristics comprising:

a. a plurality of first stage tri-sorters for sorting the cullets, wherein the plurality of first stage tri-sorters direct the sorted cullets into a plurality of first output paths;

b. a second stage tri-sorter coupled to the plurality of first stage tri-sorters, the second stage tri-sorter for sorting cullets in at least one received first output path from each first stage tri-sorter, thereby forming second sorted cullets, wherein the second stage tri-sorter directs the second sorted cullets into a plurality of second output paths; and c. a third stage tri-sorter coupled to the plurality of first stage tri-sorters and the second stage tri-sorter, the third stage tri-sorter for sorting cullets in at least one received first output path received directly from each of the plurality of first stage tri-sorters and at least one received second output path, thereby forming third sorted cullets, wherein the third stage tri-sorter directs the third sorted cullets into a plurality of third output paths, wherein the plurality of first stage tri-sorters, the second stage tri-sorter and the third stage tri-sorter sort simultaneously;

wherein at least one of the plurality of first stage tri-sorters, the second stage tri-sorter and the third stage tri-sorter comprises a light emitting source comprising one or more of a blue light emitting diode and an infrared light source.

* * * * *

UNITED STATES PATENT AND TRADEMARK OFFICE

CERTIFICATE OF CORRECTION

PATENT NO. : 7,355,140 B1
APPLICATION NO. : 10/637188
DATED : April 8, 2008
INVENTOR(S) : Farook Afsari It is certified that error appears in the above-identified patent and that said Letters Patent is hereby corrected as shown below:

IN THE CLAIMS

At column 11, line 2, Claim 2, please replace "devices" with -- device -- so that the corresponding phrase reads -- the second stage sorting device --.

Signed and Sealed this

Eighth Day of July, 2008

JON W. DUDAS
*Director of the United States Patent and Trademark Office*